US009498734B2

(12) United States Patent
Bo Stieler

(10) Patent No.: US 9,498,734 B2
(45) Date of Patent: Nov. 22, 2016

(54) BALLOON INFLATING DEVICE WITH ILLUMINATING/SOUNDING EFFECT

(75) Inventor: Henrik Bo Stieler, Shenzhen (CN)

(73) Assignee: SHENZHEN PROMOTION CONCEPT CO. LTD., Shenzhen, Guangdong (CN)

( * ) Notice: Subject to any disclaimer, the term of this patent is extended or adjusted under 35 U.S.C. 154(b) by 120 days.

(21) Appl. No.: 14/373,025

(22) PCT Filed: Feb. 29, 2012

(86) PCT No.: PCT/CN2012/071758

§ 371 (c)(1),
(2), (4) Date: Jul. 17, 2014

(87) PCT Pub. No.: WO2013/107077

PCT Pub. Date: Jul. 25, 2013

(65) Prior Publication Data

US 2014/0360626 A1 Dec. 11, 2014

(30) Foreign Application Priority Data

Jan. 20, 2012 (CN) ..... 2012 1 0018744

(51) Int. Cl.
*A63H 27/10* (2006.01)
*A63H 33/22* (2006.01)
(Continued)

(52) U.S. Cl.
CPC ..... *A63H 27/10* (2013.01); *A63H 33/22* (2013.01); *F21V 3/026* (2013.01); *A63H 5/00* (2013.01);
(Continued)

(58) Field of Classification Search
CPC ..... A63H 2027/1033; A63H 27/10; A63H 33/22; A63H 2027/1058; A63H 33/00; A63H 5/00; F21V 3/026
(Continued)

(56) References Cited

U.S. PATENT DOCUMENTS 2,392,199 A * 1/1946 Steiger ..... H01Q 1/081 116/210
3,721,983 A * 3/1973 Sherer ..... H01Q 1/082 116/210
(Continued)

FOREIGN PATENT DOCUMENTS

CN 2695771 Y 4/2005
CN 101152607 A 4/2008

*Primary Examiner* — R. A. Smith
*Assistant Examiner* — Tania Courson

(57) ABSTRACT

A balloon inflating device with an illuminating/sound effect, for being provided at a gas entrance mouth of a balloon, includes an illuminating lamp/sounder, a battery and a shell. The shell covers at least the illuminating lamp/sounder; the illuminating lamp/sounder is mounted in front of the battery. The illuminating lamp/sounder has two wires, wherein a first wire is directly connected to the battery and a second wire extends to a back of the battery along a periphery of the battery; the shell has a discharging hole below the battery. A rotary sleeve which is hollow and provided at a back part of the battery is provided within the shell. The rotary sleeve has a gas hole or a gas groove for discharging gas into the balloon; and the shell is sleeved with the rotary sleeve.

5 Claims, 9 Drawing Sheets

(51) Int. Cl.
*F21V 3/02* (2006.01)
*A63H 33/00* (2006.01)
*A63H 5/00* (2006.01)

(52) U.S. Cl.
CPC ..... *A63H 33/00* (2013.01); *A63H 2027/1033* (2013.01); *A63H 2027/1058* (2013.01)

(58) Field of Classification Search
USPC ..... 116/173, 210, DIG. 8, DIG. 9; 141/98; 446/175–176, 213, 219, 220, 224, 397, 446/485
See application file for complete search history.

(56) References Cited

U.S. PATENT DOCUMENTS 4,737,133 A * 4/1988 Neumeier ..... A63H 27/10 446/222
4,794,498 A * 12/1988 Neumeier ..... A63H 27/10 362/186
4,920,674 A * 5/1990 Shaeffer ..... A63H 27/10 116/210
5,335,689 A * 8/1994 Reittu ..... G01W 1/08 137/231
5,669,702 A * 9/1997 Wang ..... A63B 43/06 362/234
6,012,826 A * 1/2000 Chabert ..... F21V 3/026 362/267
6,082,287 A * 7/2000 Kolar ..... B64B 1/40 116/210
6,109,203 A * 8/2000 Mears ..... B63C 9/0005 116/210
7,344,267 B2 * 3/2008 Carito ..... A63H 27/10 362/189
7,478,779 B2 * 1/2009 Nguyen ..... F21V 3/023 244/24
7,571,875 B2 * 8/2009 Nguyen ..... F21V 3/023 244/24
7,922,116 B2 * 4/2011 Nguyen ..... F21V 3/023 244/24
8,292,454 B2 * 10/2012 Schrimmer ..... A63H 27/10 362/184
8,727,919 B1 * 5/2014 Gentile ..... A63B 43/06 473/570
8,950,888 B2 * 2/2015 Halliburton ..... A63H 27/10 244/31
9,192,871 B2 * 11/2015 Henrik ..... A63H 27/10
9,192,872 B2 * 11/2015 Hakam ..... A63H 27/10
2004/0037071 A1 * 2/2004 Lee ..... F21V 21/096 362/190
2005/0269442 A1 * 12/2005 Nguyen ..... F21V 3/023 244/31
2010/0041303 A1 * 2/2010 Koonce, Jr. ..... A63H 27/10 446/220
2012/0129420 A1 * 5/2012 Wu ..... A63H 27/10 446/220
2012/0314406 A1 * 12/2012 Halliburton ..... A63H 27/10 362/191
2014/0235135 A1 * 8/2014 Henrik ..... A63H 27/10 446/220
2015/0060599 A1 * 3/2015 Hakam ..... A63H 27/10 244/31

* cited by examiner

BALLOON INFLATING DEVICE WITH ILLUMINATING/SOUNDING EFFECT

CROSS REFERENCE OF RELATED APPLICATION

This is a U.S. National Stage under 35 U.S.0 371 of the International Application PCT/CN2012/071758, filed Feb. 29, 2012, which claims priority under 35 U.S.C. 119(a-d) to CN 201210018744.7, filed Jan. 20, 2012.

BACKGROUND OF THE PRESENT INVENTION

1 . Field of Invention

The present invention relates to accessories of balloons, and more particularly to a balloon inflating device with an illuminating/sounding effect.

2 . Description of Related Arts

The balloons are the common ornaments in people's daily life. In most cases, the balloons are inflated by users to decorate the environment.

However, such usage is too monotonous to satisfy various needs of the users. Thus the balloons with respective unique effects are created, such as the luminous balloons, the illuminating balloons and the sounding balloons. The Chinese patent application CN200610122541.7 discloses the luminous balloon which has an illumination effect, wherein the LED lamp is the light source; and the luminous circuit device which is supplied with power by the silicon photocell is arranged in the plastic shell having the air hole. The luminous balloon is simple in structure and convenient for using. The luminous balloon is suitable not only for being held in hand after being sleeve jointed with the plastic pipe, but also for being tied with the rope and dragged, so as to float in the air or decorate the night scene.

Since the balloons are usually made of latex, aluminum film or plastic, the arrangement of the luminous/sounding device in the luminous/sounding balloons becomes a serious problem. As disclosed by the Chinese patent application CN200420022834.4, the luminous device of the balloon comprises the shell and the light emitting diode, wherein the shell has the inner cavity where the transverse separator is provided; the light emitting diode, provided above the transverse separator, has the cathode connecting wire crossing through the transverse separator, and the anode connecting wire firstly connecting to the resistor and then crossing through the transverse separator to be connected to the metal contact ring; the battery is provided below the transverse separator within the shell; and the metal spring encircles the battery. The first end of the metal spring is connected to the anode of the battery, and the second end of the metal spring is higher than the top of the battery. The knob is provided below the battery and connected to the shell through the threads. The inflating valve is provided at the top of the shell, and the knob has the air hole. By tightening the knob, the knob pushes up the battery, in such a manner that the circuit is connected and the light emitting diode lights up. According to the Chinese patent application CN200420022834.4, the balloon emits the light under the control of the circuit and can be widely applied in various night activities.

However, in the Chinese patent application CN200420022834.4, the light emitting structure is relatively complicated; the circuit of the light emitting structure is connected and disconnected by raising and lowering the battery, controlled by the cooperating spring and knob, which complicates the control structure and increases the weight of the light emitting device, unfavorable for the lifting off of the balloon. It always takes a relatively long pushing route to raise and lower the battery, which is also unfavorable for switching on and off the light; moreover, the over-long route may cause the defected sealing, resulting in the air leakage of the balloon. The air inlet of the luminous device is above the battery, which hinders the smooth entering of the air and cause inconvenience in blowing.

SUMMARY OF THE PRESENT INVENTION

An object of the present invention is to provide a balloon inflating device with an illuminating/sounding effect to overcome the above problems, wherein the balloon inflating device is simple in structure and light in weight, and facilitates a control of a balloon illuminating/sounding device and an inflation of a balloon.

Another object of the present invention is to provide a balloon inflating device with an illuminating/sounding effect which is cheap, well sealed, liable to be installed in a balloon and easy for usage.

Accordingly, in order to accomplish the above objects, the present invention adopts following technical solutions.

A balloon inflating device with an illuminating/sounding effect, for being provided at a gas entrance mouth of a balloon, comprises an illuminating lamp/sounder, a battery and a shell, wherein the shell covers at least the illuminating lamp/sounder; and the illuminating lamp/sounder is fixed in front of the battery. The illuminating lamp/sounder has two wires, a first wire being directly connected to the battery and a second wire extending towards a back of the battery along a periphery of the battery. The shell has a discharging hole provided on the shell behind the battery. The balloon inflating device further comprises a rotary sleeve provided within the shell, wherein the rotary sleeve is hollow and provided at the back of the battery; the rotary sleeve has a gas hole or a gas groove, for discharging gas into the balloon. The shell is sleeved with the rotary sleeve.

An inner end of the rotary sleeve, the end which extends into the shell, has a protruding convex embossment for resisting and holding the battery or the wire, or for supporting other elements which connect a circuit of the battery, wherein "inner" represents a direction towards an internal of the balloon which has the balloon inflating device mounted therein. An annulus platform which is lower than the convex embossment is provided at an external edge of the convex embossment. The annulus platform has at least one gas hole above which is the discharging hole of the shell. Or the rotary sleeve has the gas groove, preferably long-strip-shaped, at a wall of the rotary sleeve, wherein a top end of the gas groove is close to the discharging hole of the shell, for smoothly blowing gas into the balloon and facilitating an inflation of the balloon.

An outer end of the rotary sleeve, the end which extends outwardly, forms a gas entrance, in such a manner that the balloon is directly blown with gas through the rotary sleeve, wherein "outer" represents a direction out of the balloon.

The convex embossment of the rotary sleeve has a concave slot where a metal spiral plate is embedded. Two ends of the metal spiral plate extend out of the concave slot, for contacting with the wire to connect the circuit, in such a manner that the illuminating lamp/sounder is switched on and off by rotating the rotary sleeve.

The metal spiral plate has two metal spiral wings stretching outwardly from the two ends. A top side of the metal spiral plate is for resisting and holding a bottom of the battery; or, an external end of the metal spiral wing, lower than the wire which extends towards the back of the battery, is for resisting and holding the wire to contact the bottom of the battery. By rotating the rotary sleeve, the metal spiral wing is able to contact with the wire, or to resist and hold the wire, in such a manner that the wire and the battery are connected by the metal spiral wing, so as to switch on and off the illuminating lamp/sounder.

The metal spiral wing is arc-shaped, which facilitates providing the metal spiral wing on the convex embossment and rotating with the convex embossment.

Through the metal spiral wing, the illuminating lamp/sounder is controlled to switch on and off just by horizontally rotating the rotary sleeve, with no necessity of spirally raising or lowering the rotary sleeve, which enhances a sealing performance of the balloon inflating device of the present invention.

An outer end of the shell slightly expands outwardly to form an embedding part for embedding the rotary sleeve, wherein the discharging hole is provided above the embedding part to shorten a moving route of the gas which is blown into the balloon. The balloon inflating device further comprises a first sealing device provided between the embedding part and the rotary sleeve, for preventing a gas leakage or reflux. The shell and the rotary sleeve are connected through a close structural engagement therebetween, other than threads, which enhances a sealing performance of the engagement and avoids the gas leakage.

In order to facilitate blowing gas, a blowing element is connected to the outer end of the rotary sleeve. The blowing element is embedded on the rotary sleeve and connected to the rotary sleeve via a close engagement or threads.

Preferably, a second sealing device is provided between the rotary sleeve and the blowing element to prevent the gas leakage.

A middle part of the shell has two protuberances which form a concave part therebetween. The concave part is for embedding the gas mouth of the balloon and mounting the balloon.

A protective cover covers up the outer end of the shell. The protective cover is mounted with the shell; the protective cover is in a shape of a trapezoid. A narrowest part of the trapezoid is provided at the very outer end of the shell; then, the trapezoid enlarges towards the middle part of the shell and forms an enlargement at the middle part of the shell, wherein the enlargement is close to the protuberances on the shell. The gas mouth of the balloon is embedded behind the concave part, in such a manner that the enlargement protects the embedded gas mouth and prevents the gas mouth from falling off against external forces.

A blowing valve is embedded within the blowing element. Specifically speaking, an end of the blowing element is embedded on the rotary sleeve and contracts inwardly to form a contraction part on which the blowing valve is sleeved; a third sealing device is provided between the blowing valve and the contraction part; the rotary sleeve is provided at an inner side of the blowing valve and has a convex shoulder for restricting the blowing valve between the rotary sleeve and the blowing element.

The first sealing device is one member selected from a group consisting of an O-ring, a sealing annular and a sealing ring (such as an elastic ring or a rubber ring). Or the first sealing device is an engaging mechanism formed by the rotary sleeve and the shell. For example, an external surface of the rotary sleeve and the shell are closely engaged or embedded with each other; the rotary sleeve and the shell are fastened with each other, both of which accomplish sealing up a gas passage and embody the sealing device. It is the same case with the second and the third sealing devices.

According to the present invention, a gas inflation hole of the balloon inflating device is at a short distance from the gas entrance mouth of the balloon, which facilitates inflating gas; combined with controlling the illuminating lamp/sounder to switch on and off by rotating, the balloon inflating device has a short control route to be liable to control, a secure and reliable structure and a good sealing performance.

Moreover, the balloon inflating device of the present invention has a simple structure, low costs, the good sealing performance and is liable to be installed into the balloon.

These and other objectives, features, and advantages of the present invention will become apparent from the following detailed description, the accompanying drawings, and the appended claims.

DETAILED DESCRIPTION OF THE PREFERRED EMBODIMENT

Figure 1:
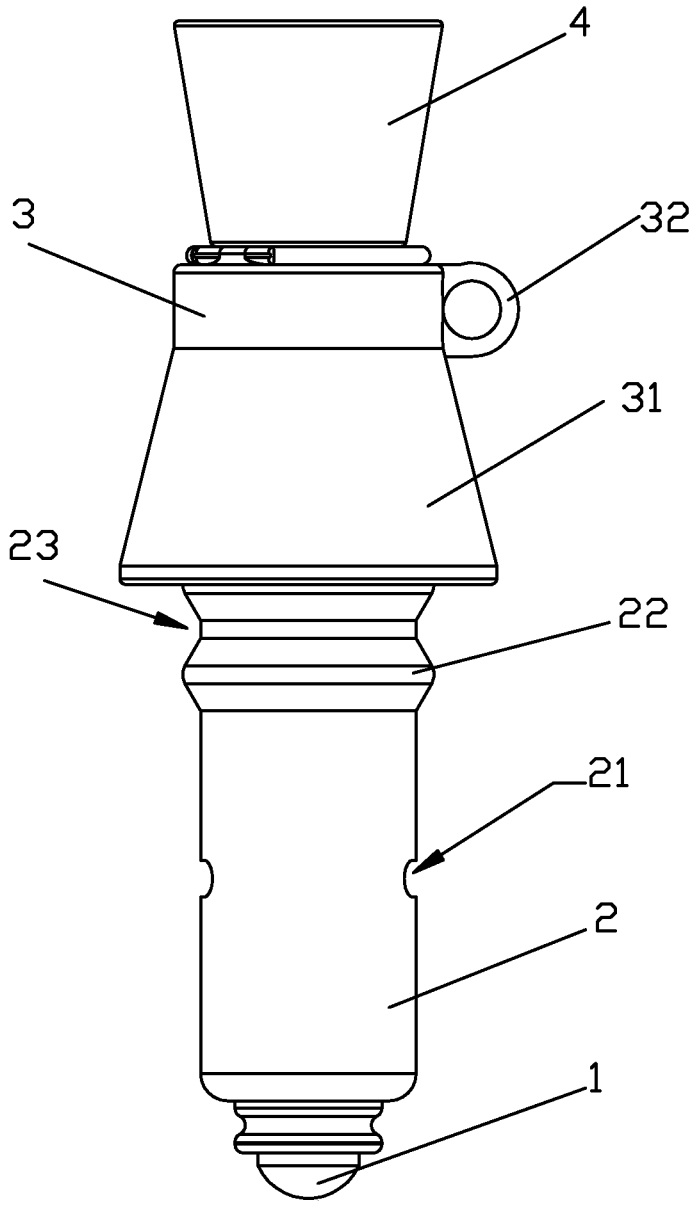
FIG. 1 is a sketch view of a balloon inflating device with an illuminating/sounding effect according to a first preferred embodiment of the present invention.

One skilled in the art will understand that the embodiment of the present invention as shown in the drawings and described above is exemplary only and not intended to be limiting. In the following illustration, a direction towards an internal of a balloon is defined as inner and a direction out of the balloon is defined as outer.

Referring to FIGS. 1-4 of the drawings, according to a first preferred embodiment of the present invention, a balloon inflating device with an illuminating effect comprises an LED lamp 1 for illuminating, a shell 2, a protective cover 3, a blowing element 4, a battery 5 and a rotary sleeve 6.

The LED lamp 1 has two wires extending outwardly, wherein a first wire 11 is directly connected between the LED lamp 1 and the battery 5; and a second wire 12 firstly bends outwardly, extends along an external wall of the battery 5 to a bottom of the battery 5 and then bends inwardly to form a bent part. The bend part aims at the bottom of the battery 5; via being resisted and held by the rotary sleeve 6, the bent part is able to contact the battery 5 to form an electric loop, so as to light up the LED lamp 1.

Figure 2:
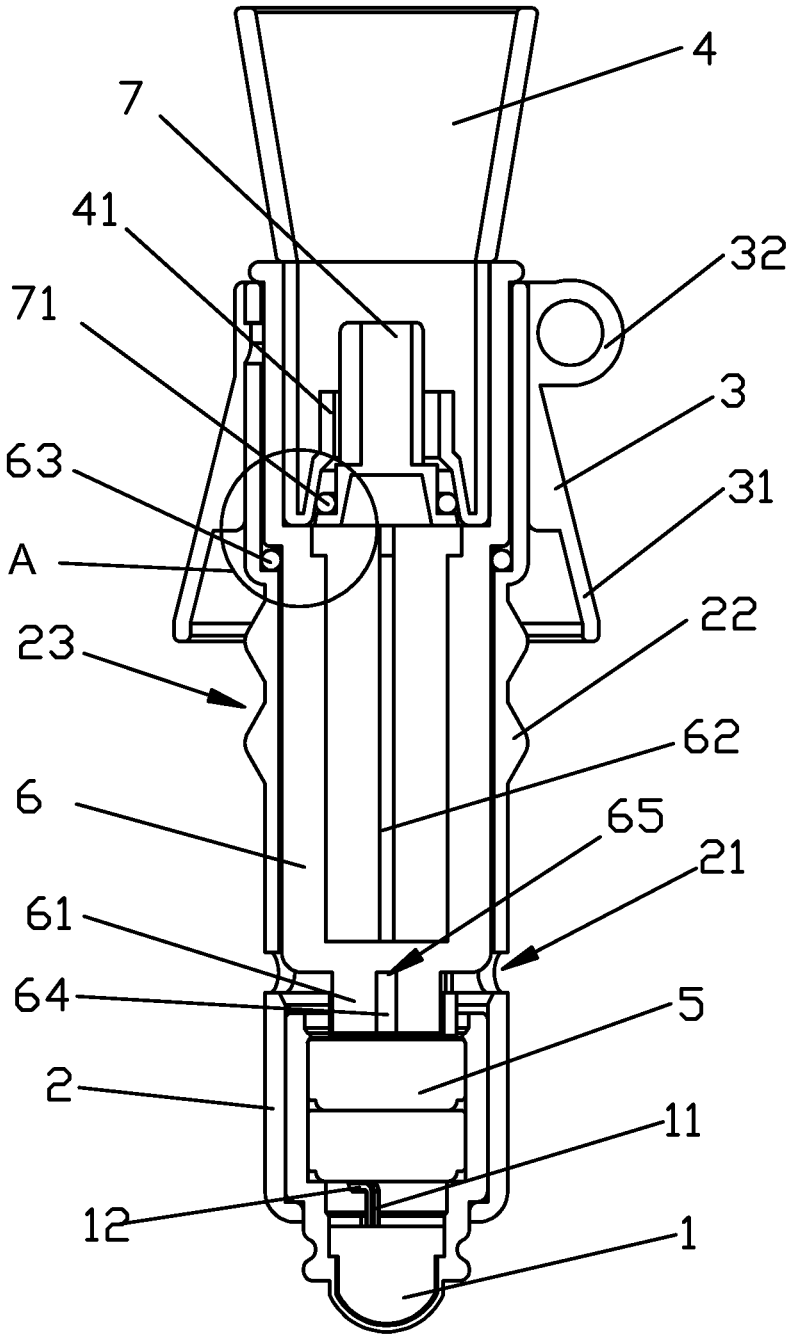
FIG. 2 is a sectional view of the balloon inflating device according to the first preferred embodiment of the present invention.

The battery 5 is usually embodied as one button cell to four button cells; as showed in FIG. 2, two button cells are only for exemplary and not intended to be limiting. The LED lamp 1 has an end exposed out of the shell, and the rest part mounted within the shell 2 together with the battery 5. The shell 2 is hollow; a front end of the shell 2 is mounted with the LED lamp 1 and the battery 5, and a back end of the shell 2 extends backwardly and is embedded with the rotary sleeve 6.

A wall of the shell 2 has a plurality of discharging holes 21 at an outer end of the battery 5. The shell 2 has two separated protuberances 22 provided at an external wall in a middle of the shell 2; and the two separated protuberances 22 form a concave part 23 therebetween. In order to mount a balloon onto the balloon inflating device, a gas mouth of the balloon is embedded via the concave part 23.

The protective cover 3 covers up an outer end of the shell 2 and mounted with the shell 2. The protective cover 3 is in a shape of a trapezoid. A narrowest part of the trapezoid is provided at the very outer end of the shell 2; then the trapezoid enlarges towards the middle of the shell 2 and forms an enlargement 31 at the middle of the shell 2, wherein the enlargement 31 is close to the protuberances 22 on the shell, in such a manner that when the gas mouth of the balloon is embedded behind the concave part 23, the enlargement 31 protects the embedded gas mouth and prevents the gas mouth from falling off against external forces. The protective cover 3 further has a convex ring 32 through which the balloon is tied with a rope or other elements.

The rotary sleeve 6 is hollow. An inner end of the rotary sleeve 6 extends into the shell 2 and has a protruding convex embossment 61 for resisting and holding the second wire 12 to connect a circuit of the LED lamp 1. A wall of the rotary sleeve 6 has a gas groove 62 in a shape of a long strip, for facilitating blowing gas; a top end, i.e., an inner end, of the gas groove 62 is close to the discharging holes 21 of the shell 2, for shortening a route at which the gas is blown into the balloon and further facilitating blowing gas.

Figure 3:
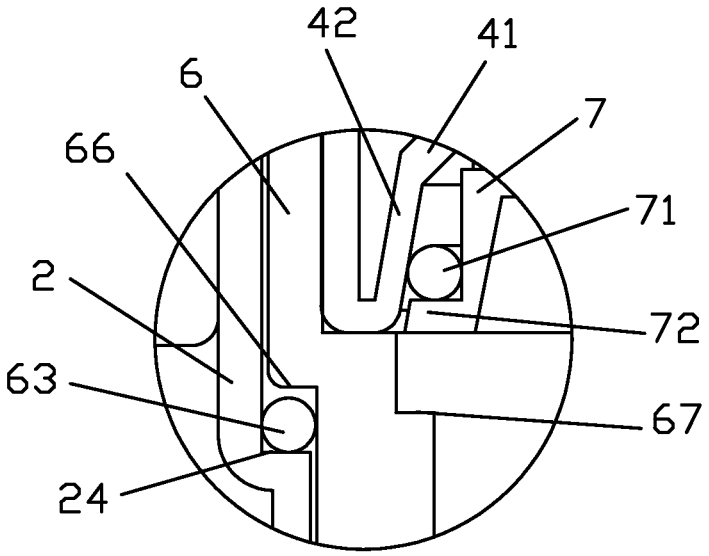
FIG. 3 is an enlargement view of part A of FIG. 2.
Figure 4:
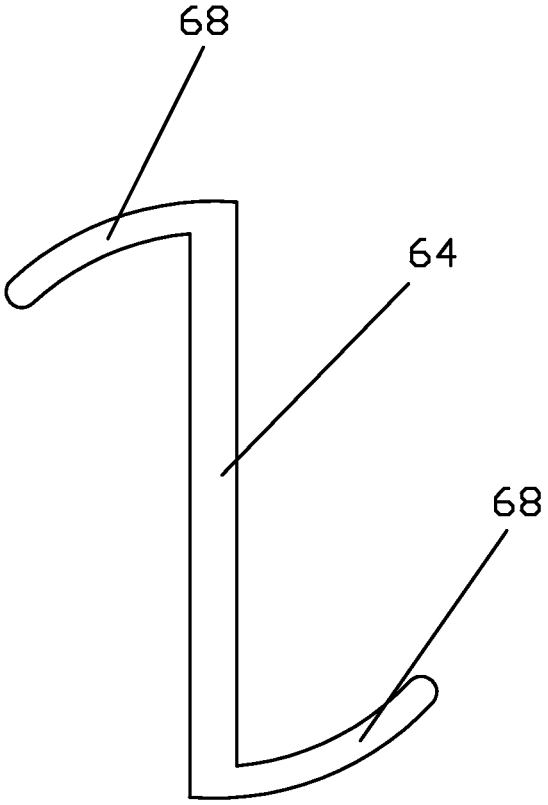
FIG. 4 is a sketch view of a metal spiral plate according to the first preferred embodiment of the present invention.
Figure 5:
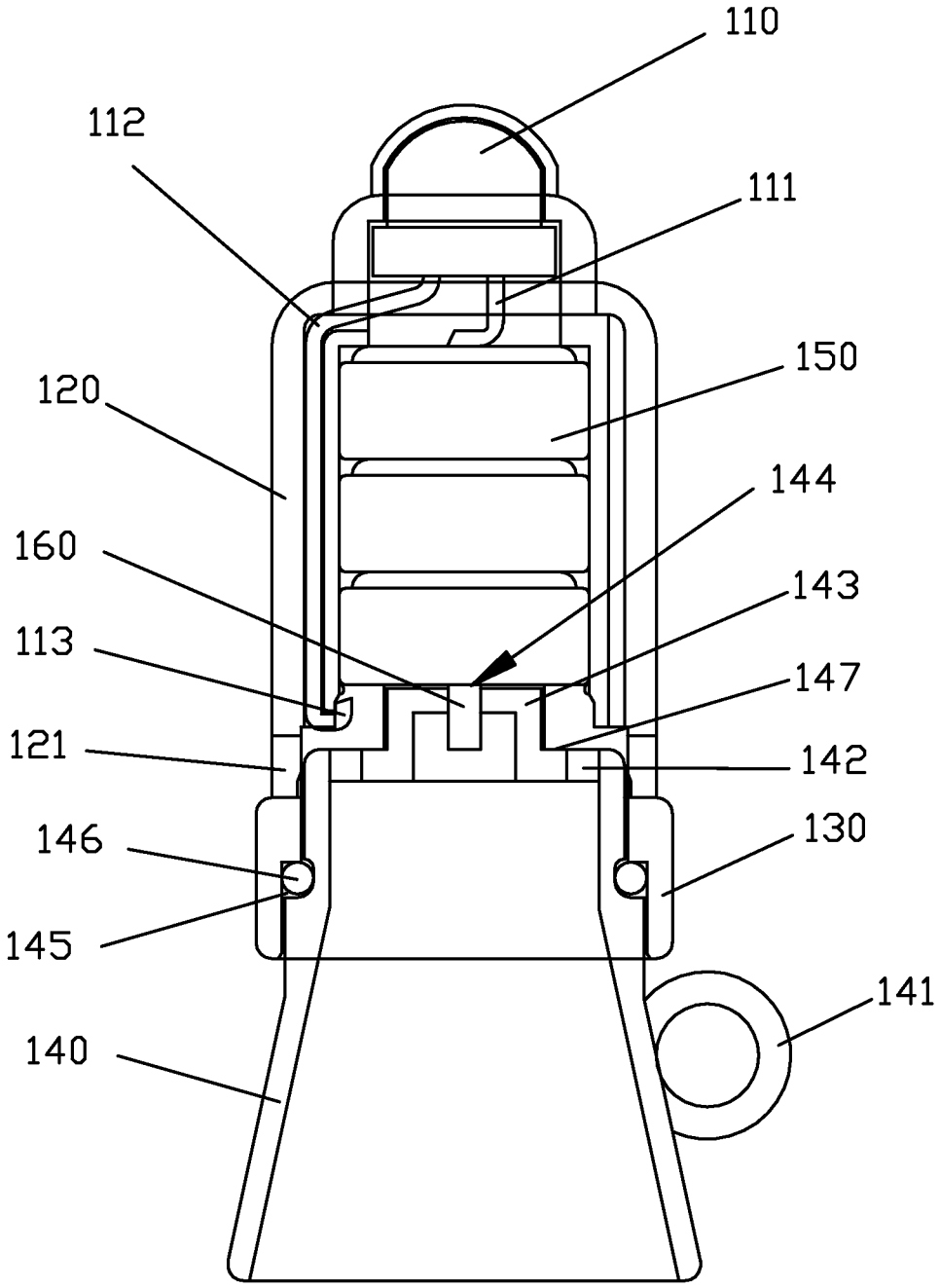
FIG. 5 is a sectional view of the balloon inflating device with the illuminating/sounding effect according to a second preferred embodiment of the present invention.

Further referring to FIG. 3, a first sealing ring 63 is provided between the rotary sleeve 6 and the shell 2, for sealing and preventing a gas leakage. Specifically speaking, an external wall of the rotary sleeve 6 slightly expands outwardly to form a rotary sleeve shoulder 66; correspondent to the rotary sleeve shoulder 66, an internal wall of the shell 2 also expands outwardly to form an internal shoulder 24. The first sealing ring 63 is provided between the rotary sleeve shoulder 66 and the internal shoulder 24, for effectively sealing the rotary sleeve 6 and the shell 2 and avoiding the gas leakage.

Since the rotary sleeve 6 is hollow, the balloon can be directly blown with gas via the rotary sleeve 6. However, in order to facilitate blowing gas, according to the first preferred embodiment of the present invention, the balloon inflating device further comprises a blowing element 4 connected to an outer end of the rotary sleeve 6. The blowing element 4 is embedded with the rotary sleeve 6 and engaged with the rotary sleeve 6 through threads, in such a manner that during practical usage, the blowing element 4 is held still and the rotary sleeve 6 is rotated to switch on and off the LED lamp 1.

A blowing valve 7 is embedded within the blowing element 4. Referring to FIG. 3, an inner end of the blowing element 4, through which the blowing element 4 is embedded with the rotary sleeve 6, contracts inwardly to form a contraction part 41. The contraction part 41 has a cone-shaped part 42. The blowing valve 7 passes through and protrudes out of the contraction part 41. The blowing valve 7 has an external edge 72 provided at an inner end of the blow valve 7, the external edge 72 being larger than the contraction part 41 in such a manner that the blowing valve 7 is restricted within the blowing element 4. A second sealing ring 71 is provided between the external edge 72 and the cone-shaped part 42, for sealing the outer edge 72 and the cone-shaped part 42 after the balloon is inflated and avoiding the gas leakage or a gas reflux. Besides, the rotary sleeve 6, provided at an inner side of the blowing valve 7, has a convex shoulder 67 protruding inwardly, in such a manner that the blowing valve 7 is restricted between the rotary sleeve 6 and the blowing element 4.

A middle of the convex embossment 61 of the rotary sleeve 6 has a concave slot 65 inside which a metal spiral plate 64 is embedded. The metal spiral plate 64 is slightly higher than the convex embossment 61 to contact with the bottom of the battery 5. As showed in FIG. 4, the metal spiral plate 64 is Z-shaped and has two metal spiral wings 68 extending from two ends of the metal spiral plate 64, wherein the two metal spiral wings 68 are preferably arc-shaped to facilitate embedding without affecting other elements of the balloon inflating device. The metal spiral plate 64 is provided within the concave slot 65; the metal spiral wings 68 extend out of the concave slot 65. When the rotary sleeve 6 is rotated at a certain angle, the metal spiral wings 68 are able to contact the second wire 12 to connect the circuit.

In other preferred embodiments of the present invention, the metal spiral plate 64 can be thicken at any side of a middle, or at both sides of the middle, for enhancing a strength of the metal spiral plate 64.

According to the first preferred embodiment of the present invention, a mouth for blowing gas is at a short distance from the gas mouth of the balloon, which facilitate blowing; combined with controlling the illuminating lamp/sounder to switch on and off by rotating, the balloon inflating device has a short control route to be liable to control, and a secure and reliable structure; moreover, the illuminating lamp/sounder is controlled to switch on and off merely by horizontally rotating the rotary sleeve, which avoids a defected sealing caused by spirally rotating and results in a good sealing performance Referring to FIGS. 5-8, according to a second preferred embodiment of the present invention, the balloon inflating device with the illuminating effect comprises an LED lamp 110, a shell 120, a rotary sleeve 140 and a battery 150.

The LED lamp 110 has two wires extending outwardly, wherein a first wire 111 is directly connected between the LED lamp 110 and the battery 150; and, a second wire 112 firstly bends outwardly, extends to a bottom of the battery 150 along an external wall of the battery 150 and then bends inwardly to form a bent part 113. The bent part 113 is able to contact with a metal spiral plate 160 provided on the rotary sleeve 140, so as to connect a circuit of the LED lamp 110 and light up the LED lamp 110.

The battery 150 is usually embodies as one button cell to four button cells. As showed in FIGS. 5-8, three button cells are only for exemplary and not intended to be limiting. An end of the LED lamp 110 is exposed out of the shell 120, and the rest part of the LED lamp 110 is mounted within the shell 120 together with the battery 150. The shell 120 is hollow. A front end of the shell 120 is mounted with the LED lamp 110 and the battery 150; a back end of the shell 120 extends backwardly and is embedded with the rotary sleeve 140.

A back part of the shell 120 slightly expands outwardly to form an embedding part 130. In practical manufacture, the embedding part can be integrally produced with the shell; or, considering a convenience of assembling, the embedding part and the shell can be produced respectively. The embedding part 130 is for embedding the rotary sleeve 140. The shell 120 has a plurality of discharging holes 121 provided at a wall of the shell 120 above the embedding part 130 and below the battery 150. An amount of the discharging holes is determined according to practical needs and usually embodied as two or more than two.

The rotary sleeve 140 has a depression 145 provided at an external wall of the rotary sleeve 140; a sealing ring 146 is provided within the depression 145, in such a manner that the sealing ring 146 is provided between the embedding part 130 and the rotary sleeve 140 to prevent a gas leakage or reflux.

The rotary sleeve 140 closely engages with the embedding part 130 of the shell 120, so as to be embedded with the shell 120.

Figure 6:
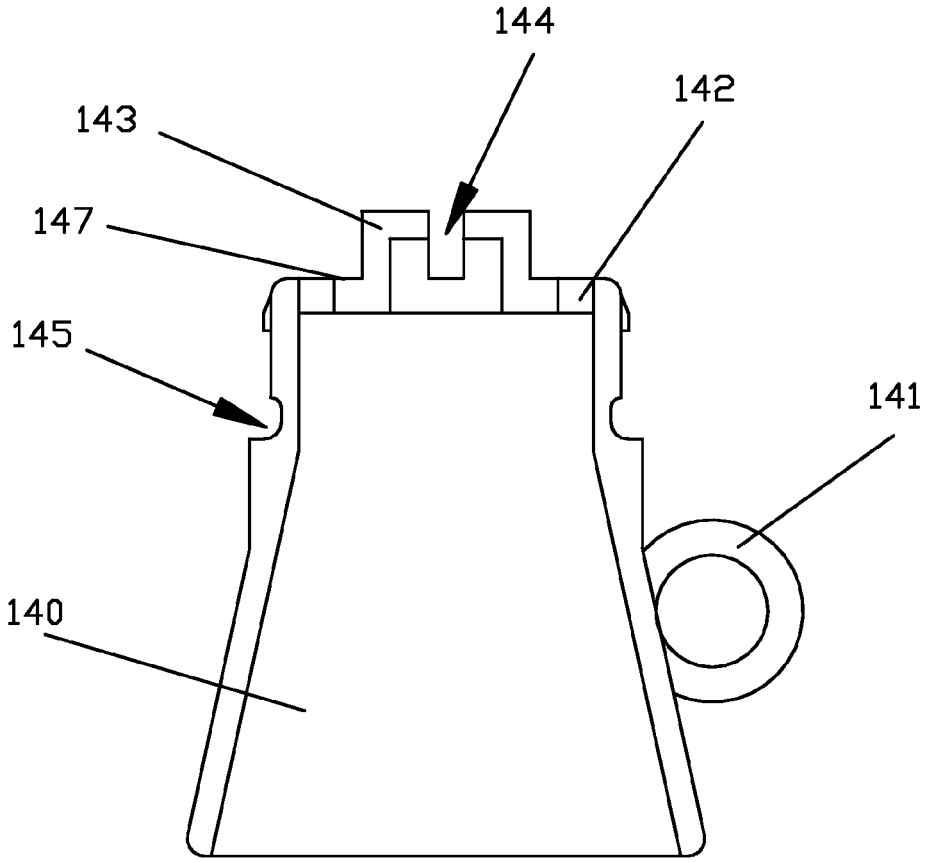
FIG. 6 is a sketch view of a rotary sleeve according to the second preferred embodiment of the present invention.
Figure 7:
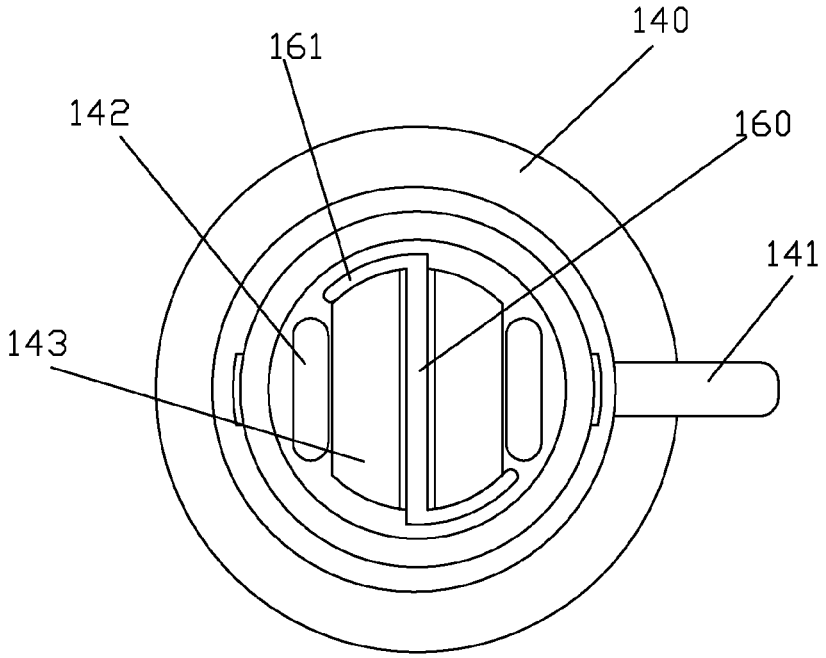
FIG. 7 is a top view of the metal spiral plate which is provided on the rotary sleeve according to the second preferred embodiment of the present invention.

Referring to FIGS. 6 and 7, an inner end of the rotary sleeve 140, the end which extends into the shell 120, has a protruding convex embossment 143 for resisting and holding the metal spiral plate 160. An annulus platform 147 which is lower than the convex embossment 143 is provided at an external edge of the convex embossment 143. The annulus platform 147 has at least one gas hole 142, usually two or more than two. According to the second preferred embodiment of the present invention, the annulus platform 147 has two gas holes 142 above which the discharging holes 121 of the shell 120 are provided, for facilitating blowing gas into a balloon and inflating the balloon.

The rotary sleeve 140 has a concave slot 144 atop; the metal spiral plate 160 is embedded inside the concave slot 144 and slightly higher than the convex embossment 143 to contact with the bottom of the battery 150. As showed in FIG. 6, the metal spiral plate 160 is Z-shaped and has two metal spiral wings 161 extending from two ends of the metal spiral plate 160. The metal spiral wings 161 are usually arc-shaped for facilitating embedding the metal spiral wings without affecting other elements of the balloon inflating device. As showed in FIG. 7, the metal spiral plate 160 is provided within the concave slot 144; the two metal spiral wings 161 extend out of the concave slot 144.

When the metal spiral plate 160 is rotated at a certain angel, the two metal spiral wings 161 are able to contact the bent part 113 of the second wire 112, which connects the circuit, thereby the LED lamp 110 is controlled to switch on and off.

An outer end of the rotary sleeve 140 extends outwardly to form a gas entrance; the balloon is directly blown with gas through the rotary sleeve 140. The rotary sleeve 140 has a protruding ring 141 provided at the external wall; through the ring 141, the balloon is tied with a rope or other elements.

Figure 8:
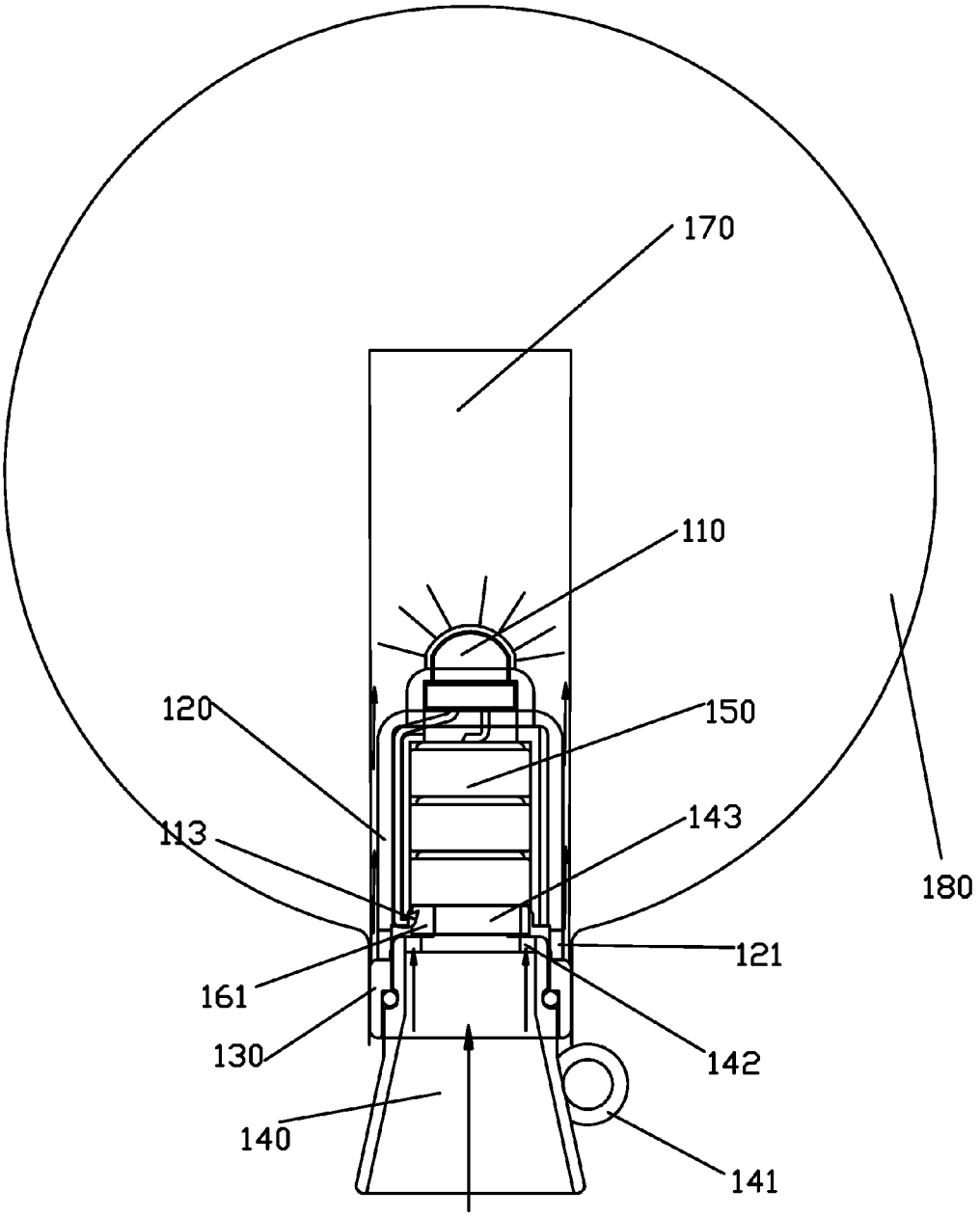
FIG. 8 is a sketch view of the balloon inflating device applied in a balloon according to the second preferred embodiment of the present invention.

FIG. 8 shows the balloon inflating device with the illuminating effect, according to the second preferred embodiment of the present invention, installed inside the balloon made of aluminum film or plastic. A transparent plastic plate 170 is mounted in front of the shell 120. When the balloon is inflated, gas enters the balloon 180 from two sides of the plastic plate 170; when inflating stops, the plastic plate 170 is attached onto the shell 120 to avoid leaking; the balloon inflating device is mounted at a gas mouth of the balloon 180.

When the balloon is inflated, as indicated by arrows, the gas enters from the gas entrance of the rotary sleeve 140, through the gas holes 142 of the shell 120, and then into the balloon 180 along an internal side of the plastic plate 170, so as to inflate the balloon 180.

After the balloon 180 is inflated, the embedding part 130 is held still and the rotary sleeve 140 is rotated at 90 degrees; because of the rotated rotary sleeve 140, the metal spiral wings 161 are able to contact with the bent part 113 of the second wire 112, in such a manner that the circuit is connected and the LED lamp 110 lights up.

Conversely, the rotary sleeve 130 is rotated back at 90 degrees, and thus the metal spiral wings 161 is detached from the bent part 113, in such a manner that the circuit is disconnected and the LED lamp 110 lights off.

Figure 9:
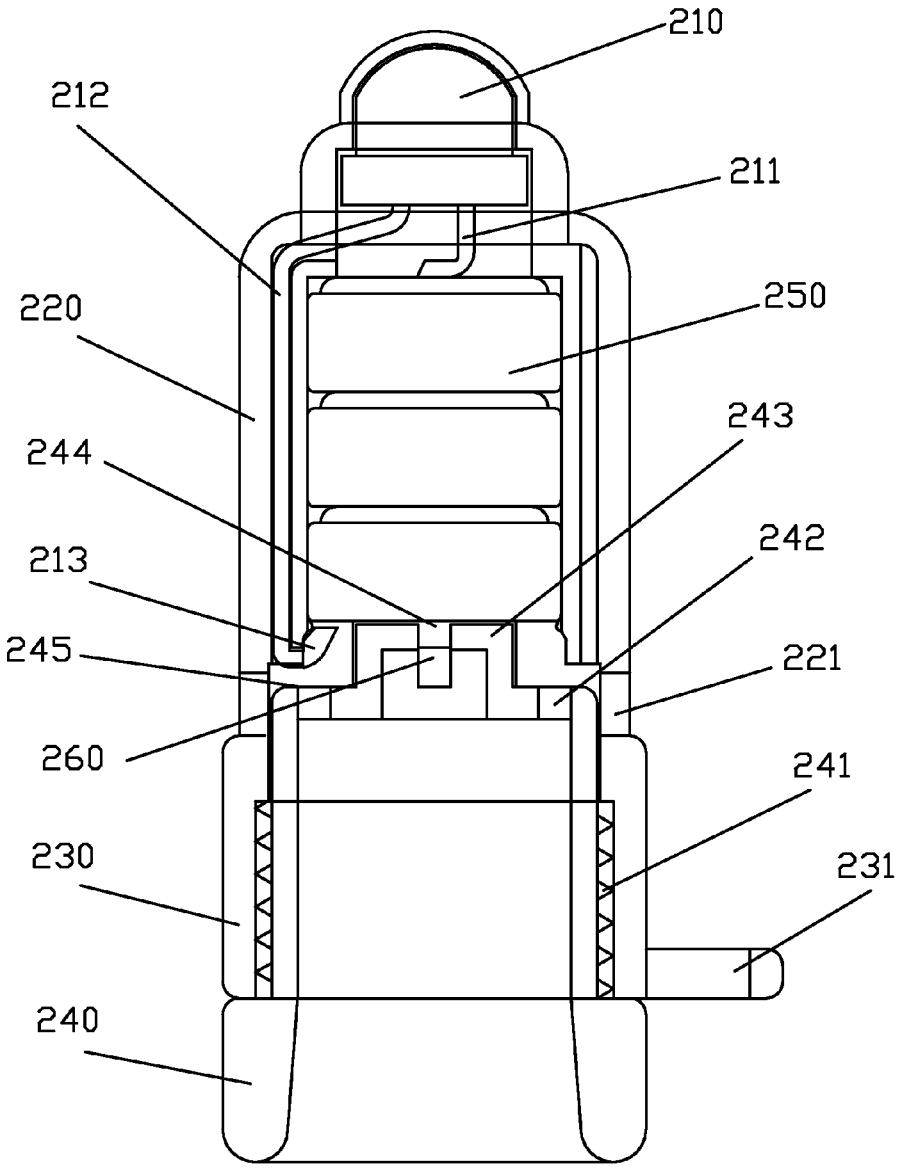
FIG. 9 is a sectional view of the balloon inflating device with the illuminating/sound device according to a third preferred embodiment of the present invention.
Figure 10:
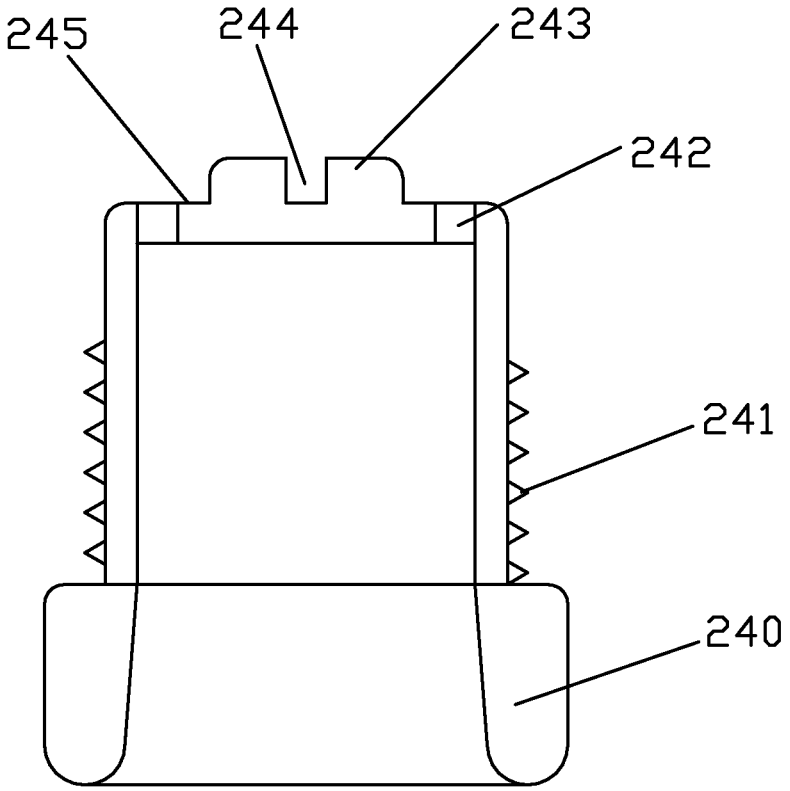
FIG. 10 is a sketch view of the rotary sleeve according to the third preferred embodiment of the present invention.
Figure 11:
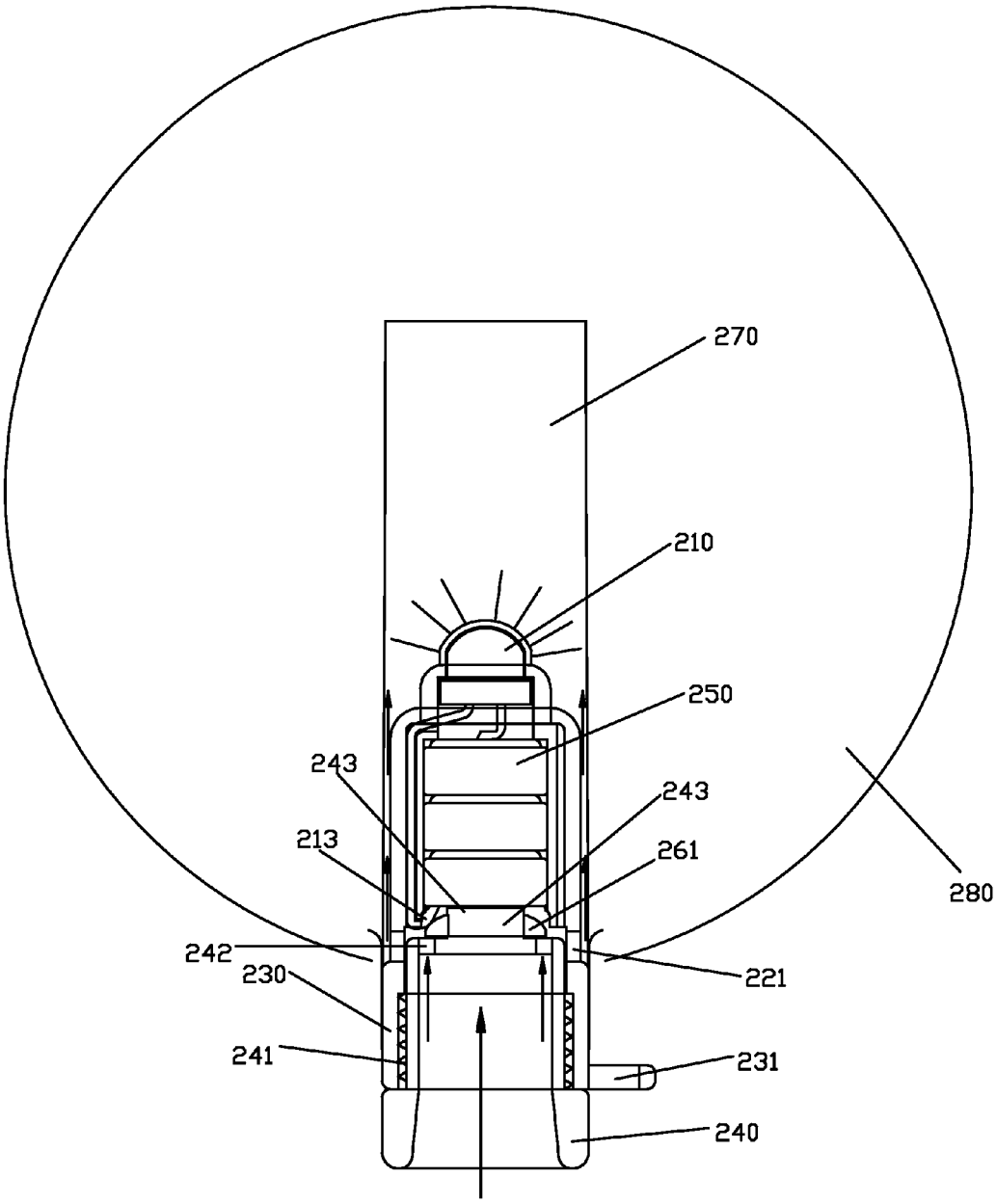
FIG. 11 is a sketch view of the balloon inflating device applied in the balloon according to the third preferred embodiment of the present invention.

Referring to FIGS. 9-11, based on the second preferred embodiment of the present invention, the balloon inflating device with the illuminating effect according to a third preferred embodiment of the present invention differs from the balloon inflating device with the illuminating effect according to the second preferred embodiment in the engagement between the rotary sleeve and the embedding part and the structure of the metal spiral plate.

Combined with FIGS. 9-11, the balloon inflating device with the illuminating effect comprises an LED lamp 210, a shell 220, a rotary sleeve 240 and a battery 250.

The LED lamp 210 has two wires extending outwardly, wherein a first wire 211 is directly connected between the LED lamp 210 and the battery 250; a second wire 212 firstly bends outwardly, extends to a bottom of the battery 250 along an external wall of the battery 250 and then bends inwardly to form a bent part 213. The bent part 213 which is resisted and held by a metal spiral plate 260 on the rotary sleeve 240, is able to contact with the bottom of the battery 250, so as to connect a circuit of the LED lamp 210 and light up the LED lamp 210. Or, the bent part 213 and the metal spiral plate 260 can adopt a connection manner as illustrated in the second preferred embodiment of the present invention.

The battery 250 is usually embodied as one button cell to four button cells. As showed in FIGS. 9-11, three button cells are only for exemplary and not intended to be limiting. An end of the LED lamp 210 is exposed out of the shell 220; the rest part of the LED lamp 210 is mounted within the shell 220 together with the battery 250. The shell 220 is hollow. A front end of the shell 220 is mounted with the LED lamp 210 and the battery 250; a back end of the shell 220 extends backwardly to form an embedding part 230.

A back part of the shell 220 slightly expands outwardly to form the embedding part 230 through which the rotary sleeve 240 is embedded. The shell 220 has a plurality of discharging holes 221 at a wall of the shell 220. An amount of the discharging holes is determined according to practical needs and usually embodied as two or more than two.

The rotary sleeve 240 has an indented part 241 provided at an outer wall of the rotary sleeve 240. Through the indented part 241, the rotary sleeve 240 is firmly embedded with the embedding part 230, in such a manner that the rotary sleeve 240 cannot be easily pulled out. Furthermore, the indented part 241 enhances a sealing performance and prevents a gas leakage or reflux.

The embedding part 230 has a protruding ring 231 through which a balloon mounted with the balloon inflating device with the illuminating effect is tied with a rope or other elements.

Further referring to FIG. 10, an inner end of the rotary sleeve 240, the end which extends into the shell 220, has a protruding convex embossment 243 for resisting and holding the metal spiral plate 260. An annulus platform 245 which is lower than the convex embossment 243 is provided at an external edge of the convex embossment 243. The annulus platform 245 has two gas holes 242 above which the discharging holes 221 of the shell 220 are provided, for facilitating blowing gas into the balloon and inflating the balloon.

The rotary sleeve 240 has a concave slot 244 atop. The metal spiral plate 260 is embedded within the concave slot 244. The metal spiral plate 260 is Z-shaped and has two metal spiral wings 261 extending from two ends of the metal spiral plate 260. The metal spiral wings 261 are arc-shaped. The metal spiral plate is provided within the concave slot 244; the metal spiral wings extend out of the concave slot 244. Two ends of each metal spiral wing 261 are externally arc-shaped to be able to resist and hold the bent part 213. When the rotary sleeve 240 is rotated at a certain angle, the metal spiral wings 261 are able to reach a bottom of the bent part 213 and resist and hold the bent part 213, in such a manner that the bent part 213 is elevated upwardly to contact the bottom of the battery 250, so as to connect the circuit and further control the LED lamp to switch on and off.

An outer end of the rotary sleeve 240 extends outwardly to form a gas entrance; the balloon is directly blown with gas through the rotary sleeve 240.

As showed in FIG. 11, the balloon inflating device with the illuminating effect is applied in the balloon made of aluminum film or plastic. A transparent plastic plate 270 is mounted in front of the shell 220. When the balloon is inflated, gas enters the balloon 280 from two sides of the plastic plate 170; when inflating stops, the plastic plate 270 is attached onto the shell 220 to avoid leaking; the balloon inflating device is mounted at a gas mouth of the balloon 280.

When the balloon is inflated, as indicated by arrows, the gas enters from the gas entrance of the rotary sleeve 240, through the gas holes 242 of the shell 220, and then into space between the rotary sleeve 240 and the shell 220; next, as indicated by arrows, the gas is discharged from the discharging holes 221 of the shell 220 into the balloon 280 along an internal side of the plastic plate 270, so as to inflate the balloon 280.

After the balloon 280 is inflated, the embedding part 230 is held still and the rotary sleeve 240 is rotated at 90 degrees; because of the rotated rotary sleeve 240, the metal spiral wings 261 are able to resist and hold the bent part 213 of the second wire 212, and elevate the bent part 213 to contact with the bottom of the battery 250, in such a manner that the circuit is connected and the LED lamp 210 lights up.

Conversely, the rotary sleeve 230 is rotated back at 90 degrees, and thus the metal spiral wings 161 are detached from the bent part 213; without being resisted and held by the metal spiral wings 261, the bent part 213 is detached from the contact with the bottom of the battery 250 via an elastic recovery of the bent part 213, in such a manner that the circuit is disconnected and the LED lamp 210 lights off.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A balloon inflating device with an illuminating effect, for being provided at a gas entrance mouth of a balloon, comprising: an illuminating lamp, a battery and a shell; the shell covering at least the illuminating lamp; the illuminating lamp being mounted in front of the battery; wherein the illuminating lamp has two wires, wherein a first wire is directly connected to the battery and a second wire extends to a back of the battery along a periphery of the battery; the shell has a discharging hole which is below the battery; and further comprising a rotary sleeve, provided inside the shell, wherein the rotary sleeve is hollow and provided at a back part of the battery; the rotary sleeve has a gas hole or a gas groove for discharging gas into the balloon; and the shell is sleeved with the rotary sleeve, wherein an inner end of the rotary sleeve extends into the shell and has a convex protruding embossment through which the battery or the second wire is resisted and held, or through which other elements for connecting a circuit of the battery is supported; an annulus platform which is lower than the convex embossment is provided at an external edge of the convex embossment; the annulus embossment has at least one the gas hole above which the discharging hole of the shell is provided, or the rotary sleeve has the gas groove at a wall of the rotary sleeve, wherein a top end of the gas groove is close to the discharging hole of the shell for facilitating blowing gas into the balloon.

2. The balloon inflating device with the illuminating effect, as recited in claim 1, wherein an outer end of the rotary sleeve expands outwardly to form a gas entrance, for directly blowing gas into the balloon through the rotary sleeve.

3. The balloon inflating device with the illuminating effect, as recited in claim 1, wherein the convex embossment of the rotary sleeve has a concave slot; a metal spiral plate is embedded inside the concave slot and two ends of the metal spiral plate extend out of the concave slot.

4. The balloon inflating device with the illuminating effect, as recited in claim 3, wherein the metal spiral plate has two metal spiral wings extending from the two ends; a top end of the metal spiral plate is for resisting and holding the bottom of the battery, or an external end of each metal spiral wing is lower than the second wire, in such a manner that the metal spiral wing is able to resist and hold the wire to contact with the bottom of the battery.

5. A balloon inflating device with an illuminating effect, for being provided at a gas entrance mouth of a balloon, comprising: an illuminating lamp, a battery and a shell; the shell covering at least the illuminating lamp; the illuminating lamp being mounted in front of the battery; wherein the illuminating lamp has two wires, wherein a first wire is directly connected to the battery and a second wire extends to a back of the battery along a periphery of the battery; the shell has a discharging hole which is below the battery; and further comprising a rotary sleeve provided inside the shell and a blowing element connected to an outer end of the rotary sleeve, wherein the blowing element is embedded with the rotary sleeve and connected to the rotary sleeve via a compact engagement or threads, wherein the rotary sleeve is hollow and provided at a back part of the battery; the rotary sleeve has a gas hole or a gas groove for discharging gas into the balloon; and the shell is sleeved with the rotary sleeve, wherein an end of the blowing element is embedded with the rotary sleeve and contracts inwardly to form a contraction part; a blowing valve is sleeved with the contraction part; a sealing device is provided between the blowing valve and the contraction part; the rotary sleeve, provided at an inner side of the blowing valve, has a protruding shoulder for restricting the blowing valve between the rotary sleeve and the blowing element.

* * * * *